US012607391B2

(12) United States Patent
Lee et al.

(10) Patent No.: US 12,607,391 B2
(45) Date of Patent: Apr. 21, 2026

(54) EVAPORATIVE CONDENSER

(71) Applicant: KYUNGDONG NAVIEN CO., LTD., Pyeongtaek-si (KR)

(72) Inventors: Myoung Seop Lee, Seoul (KR); Jae Hyun Han, Seoul (KR); Chul Ki Jeong, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 135 days.

(21) Appl. No.: 18/493,963

(22) Filed: Oct. 25, 2023

(65) Prior Publication Data

US 2024/0183590 A1 Jun. 6, 2024

(30) Foreign Application Priority Data

Dec. 2, 2022 (KR) ..... 10-2022-0166977

(51) Int. Cl.
*F25B 39/04* (2006.01)
*F28D 1/053* (2006.01)
(Continued)

(52) U.S. Cl.
CPC ..... *F25B 39/04* (2013.01); *F28D 1/05391* (2013.01); *F28D 3/02* (2013.01);
(Continued)

(58) Field of Classification Search
CPC ..... F25B 39/04; F25B 2339/041; F28D 5/00; F28D 5/02; F28D 3/00; F28D 3/02
See application file for complete search history.

(56) References Cited

U.S. PATENT DOCUMENTS 1,748,121 A * 2/1930 Gay ..... F25B 39/04 165/DIG. 175
3,313,120 A * 4/1967 Kuss ..... F25B 39/04 62/305

(Continued)

FOREIGN PATENT DOCUMENTS

KR 200286535 * 8/2002 ..... F28F 1/10
KR 20190006781 1/2019
KR 20220074734 6/2022

OTHER PUBLICATIONS

Machine translation of KR200286535 (Year: 2002).*

*Primary Examiner* — Christopher R Zerphey
(74) *Attorney, Agent, or Firm* — Dority & Manning, P.A.

(57) ABSTRACT

An evaporative condenser having improved condensation efficiency is provided. The evaporative condenser includes a condensation module including a connecting tube, a water injection module spraying water passing through the condensation module, above the condensation module, and a blowing module disposed on one side of the condensation module and supplying air passing through the condensation module. In the condensation module, N header rows including a first header extending in a first direction and having a flow path therein, a second header extending in the first direction and having a flow path therein, and a plurality of connecting tubes extending in a second direction between the first header and the second header and connecting the flow paths of the first header and the second header are stacked in a third direction, where N is a natural number greater than or equal to 2.

9 Claims, 7 Drawing Sheets

(51) Int. Cl.
*F28D 3/02* (2006.01)
*F28D 5/02* (2006.01)
*F28F 9/02* (2006.01)

(52) U.S. Cl.
CPC ..... *F28D 5/02* (2013.01); *F25B 2339/041* (2013.01); *F28F 9/0214* (2013.01)

(56) References Cited

U.S. PATENT DOCUMENTS

| | | | | | |
|---|---|---|---|---|---|
| 4,112,027 | A * | 9/1978 | Cates | F28C 1/14 | 261/DIG. 11 |
| 4,366,106 | A * | 12/1982 | Benyak | F28F 9/0131 | 165/60 |
| 4,676,071 | A * | 6/1987 | Latimer | F28D 5/02 | 62/305 |
| 4,757,695 | A * | 7/1988 | Malnar | F25B 39/04 | 62/305 |
| 2006/0179866 | A1* | 8/2006 | Ting | F28D 7/04 | 62/305 |
| 2017/0328638 | A1* | 11/2017 | Wu | F28F 9/0221 | |
| 2024/0027110 | A1* | 1/2024 | Han | F24F 1/18 | |
| 2024/0200838 | A1* | 6/2024 | Han | F25B 39/04 | |

* cited by examiner

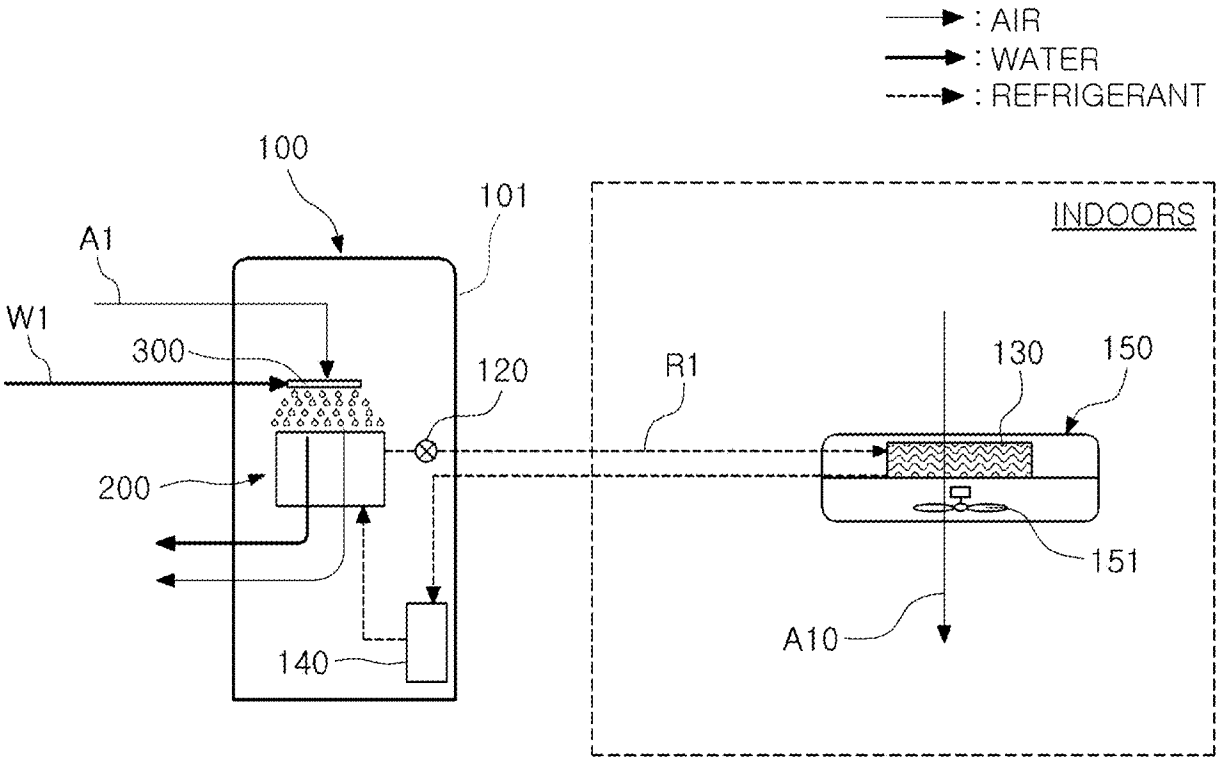
[Fig.1]

[Fig.2]
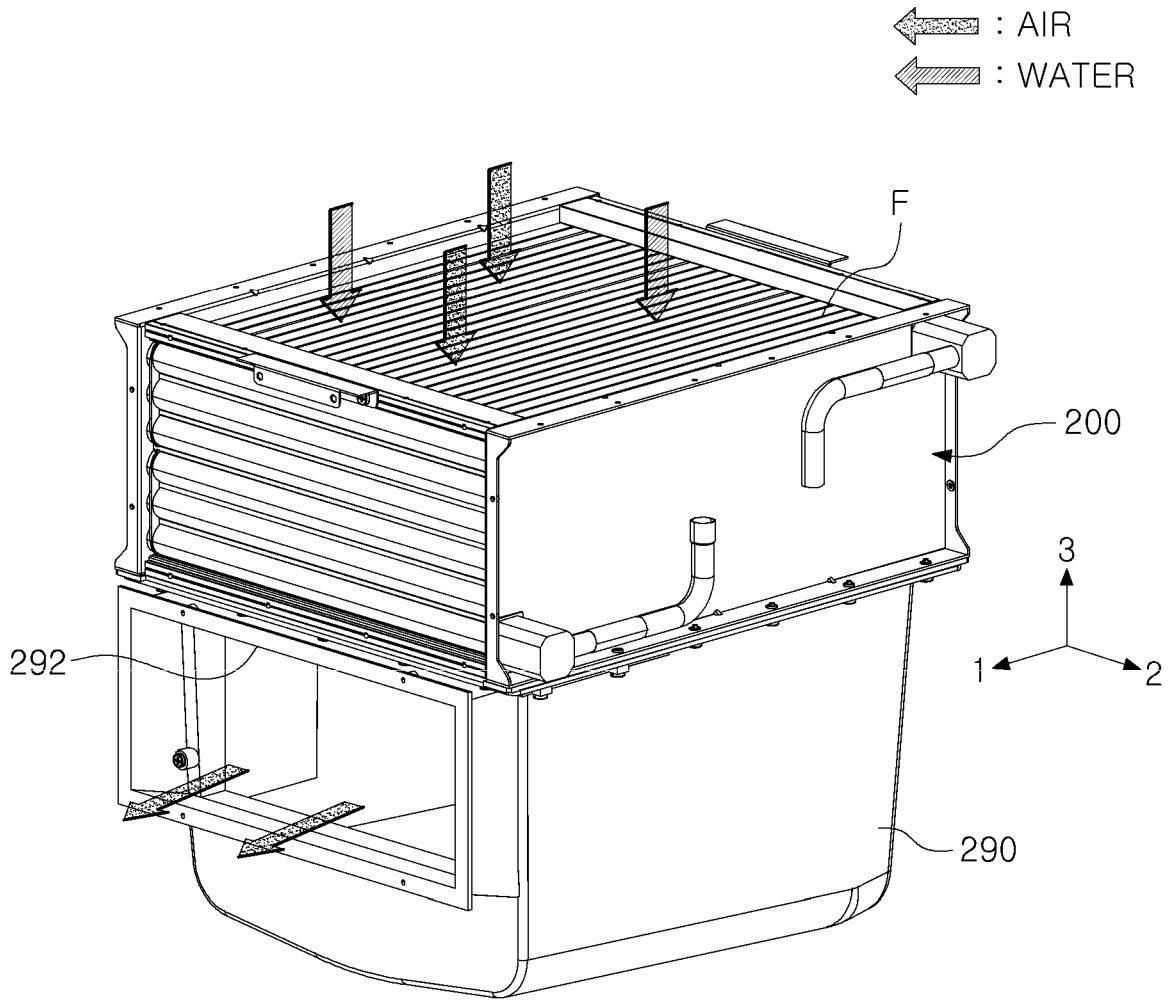

[Fig.3]
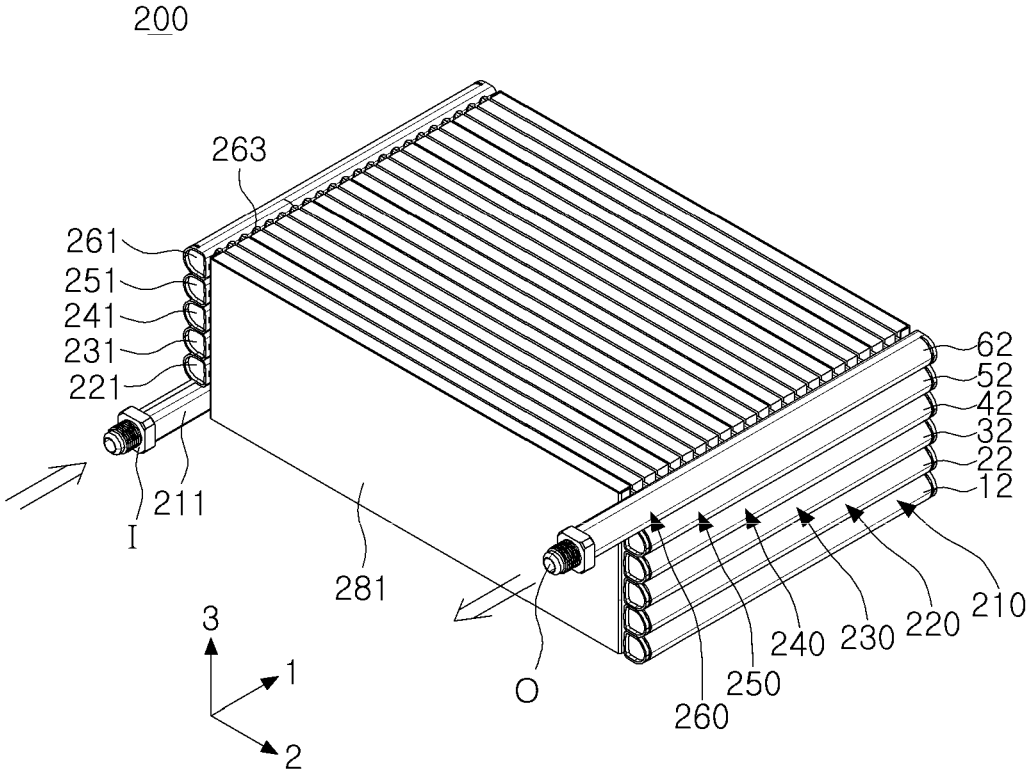

[Fig.4]
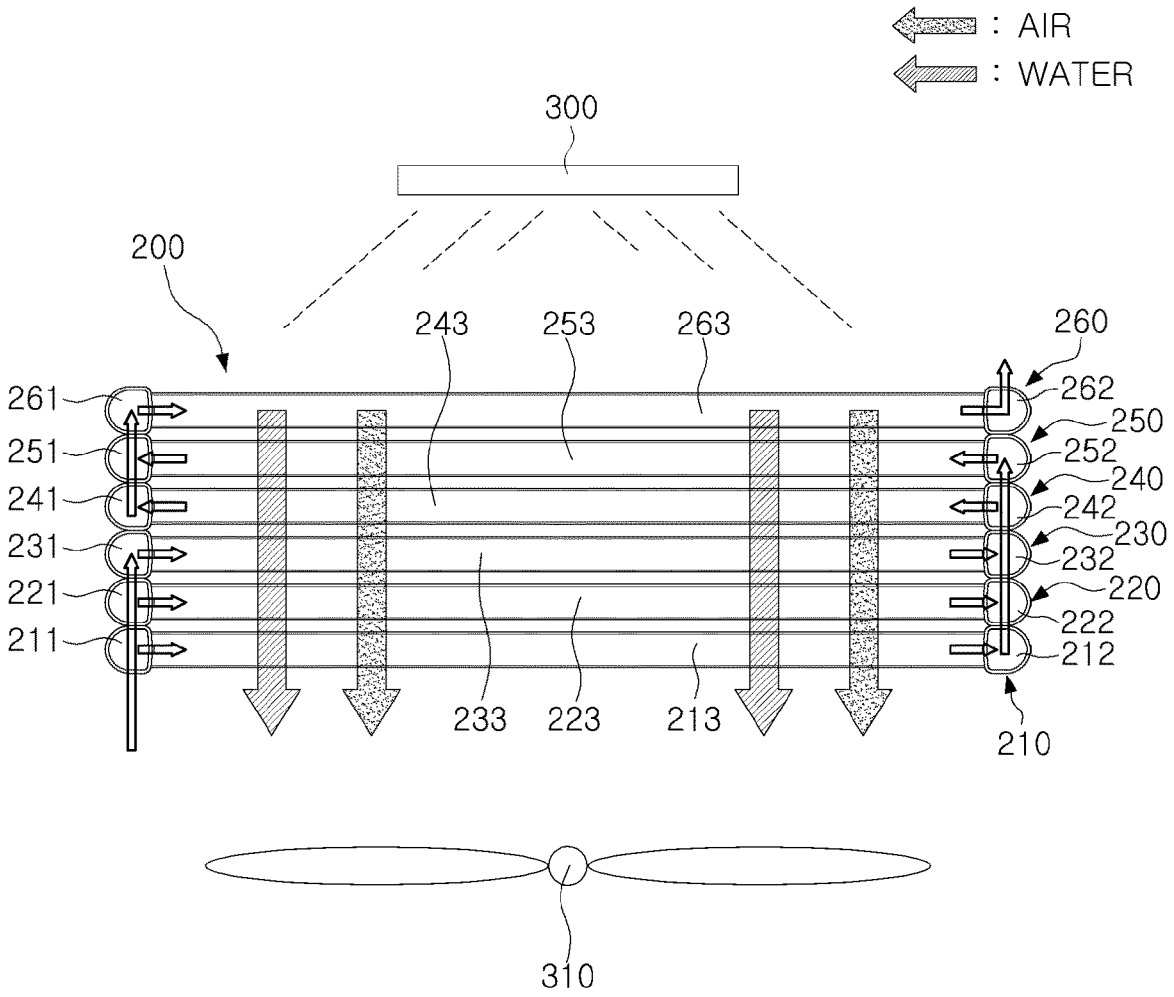

[Fig.5]
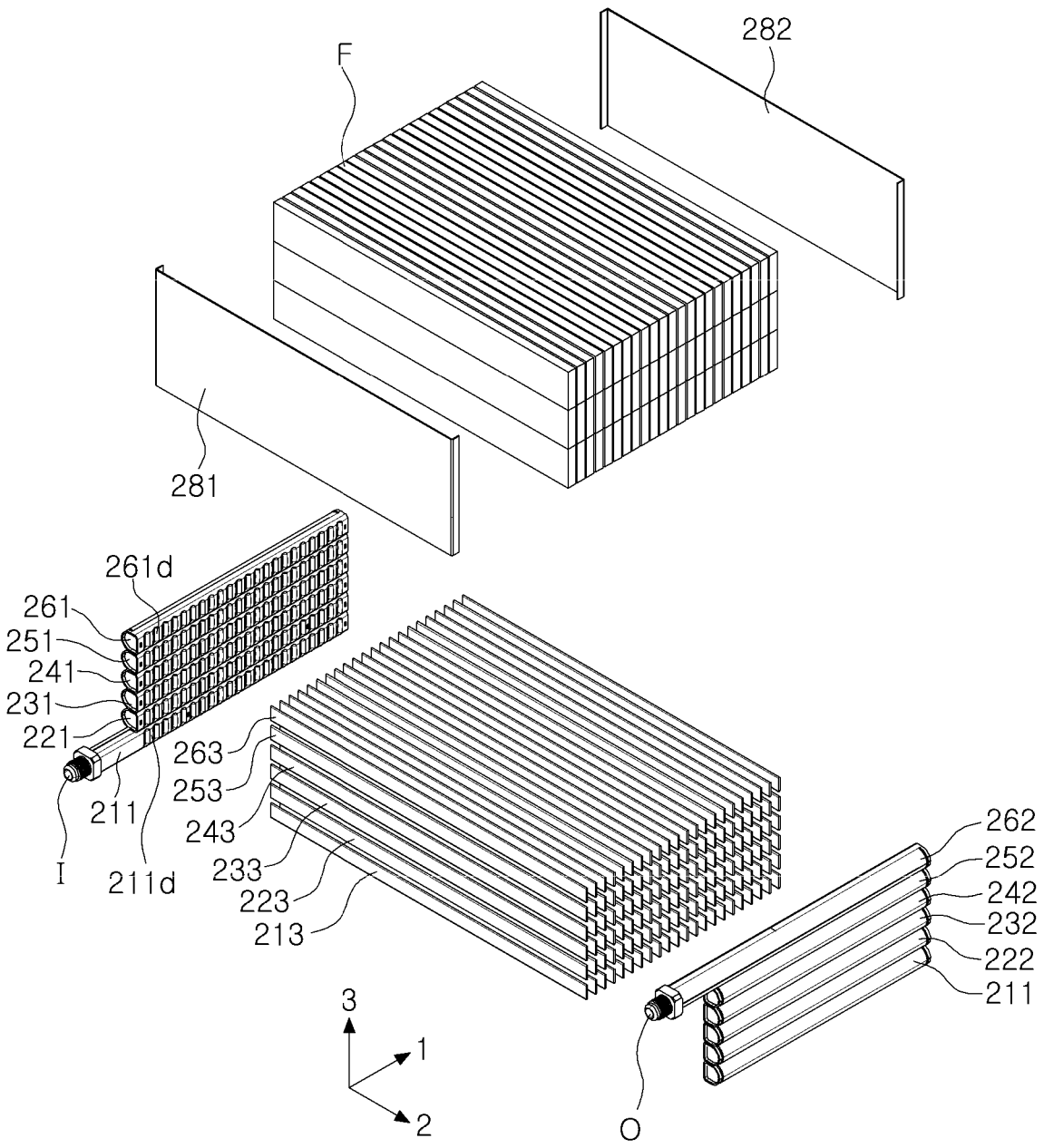

[Fig.6]
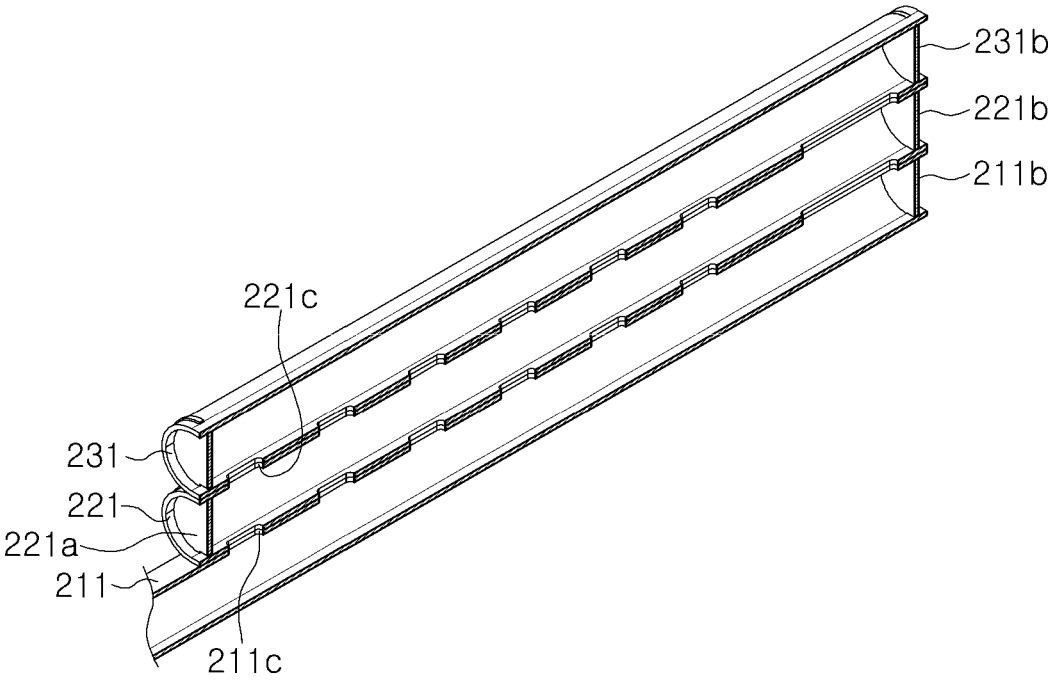

[Fig.7]
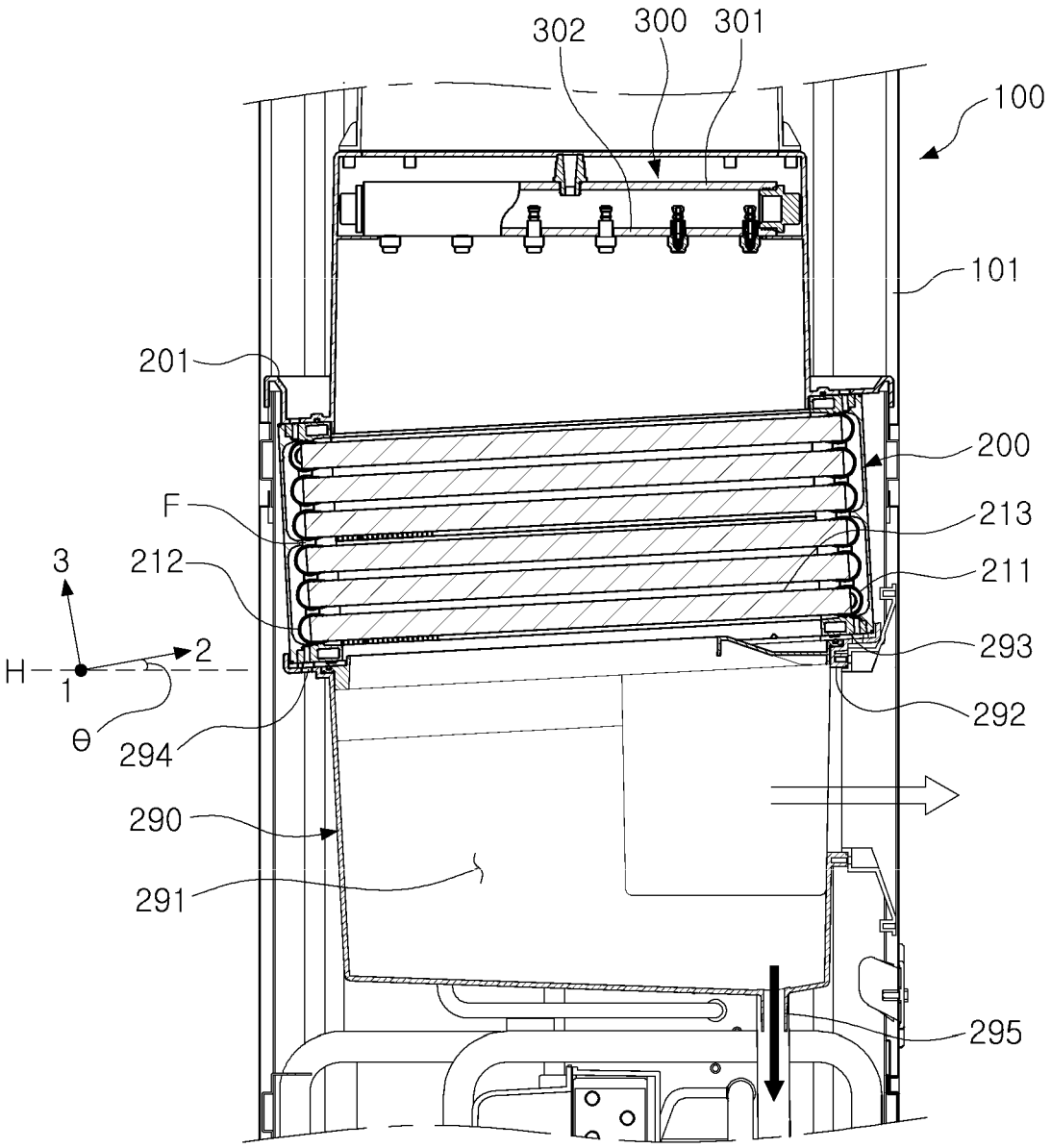

EVAPORATIVE CONDENSER

CROSS-REFERENCE TO RELATED APPLICATION(S)

This application claims benefit of priority to Korean Patent Application No. 10-2022-0166977 filed on Dec. 2, 2022 in the Korean Intellectual Property Office, the disclosure of which is incorporated herein by reference in its entirety.

BACKGROUND

1. Field

The present disclosure relates to an evaporative condenser, and more particularly, to an evaporative condenser in which heat exchange efficiency is increased while condensing a fluid by utilizing the heat of evaporation of water.

2. Description of Related Art

A condenser is a heat exchanger cooling and liquefying high-temperature, high-pressure refrigerant vapor supplied from a compressor, and serves to dissipate the heat in a refrigeration cycle externally.

Such an evaporative condenser uses a combination of water cooling and air cooling, and is configured to spray water onto the tube through which the cooling fluid passes and to flow air supplied from the blower to the surface of the tube, and to cool the cooling fluid by discharging vaporized water vapor from the surface of the tube.

Patent Document 1 discloses an evaporative condenser.

In the case of Patent Document 1, disclosed are a flat tube in which a cooling fluid flow path is formed and bent in a zigzag direction, an evaporated water supply unit supplying evaporated water to the flat tube, and a blower for supplying air in the opposite direction of the evaporated water.

In the case of Patent Document 1, since one flat tube is used, the cross section is constant from the fluid inlet side to the outlet side. However, in the condenser, the vapor is cooled and liquefied, and thus, even if the same volume is introduced, the volume decreases from the inlet side to the outlet side. When the cross section is constant, pressure loss occurs due to volume reduction.

(Patent Document 1) KR10-2019-0006781 A

SUMMARY

An aspect of the present disclosure is to provide an evaporative condenser in which condensation efficiency may be improved.

An aspect of the present disclosure is to improve the energy efficiency of an evaporative condenser by lowering static pressure of the evaporative condenser.

According to an aspect of the present disclosure, an evaporative condenser is provided as follows.

According to an aspect of the present disclosure, an evaporative condenser includes a condensation module including a connecting tube; a water injection module spraying water passing through the condensation module, above the condensation module; and a blowing module disposed on one side of the condensation module and supplying air passing through the condensation module. In the condensation module, N header rows including a first header extending in a first direction and having a flow path therein, a second header extending in the first direction and having a flow path therein, and a plurality of connecting tubes extending in a second direction between the first header and the second header and connecting the flow paths of the first header and the second header are stacked in a third direction, where N is a natural number greater than or equal to 2. The first to third directions are directions orthogonal to each other. The condensation module, the water injection module, and the blowing module are disposed in such a manner that the water sprayed by the water injection module and the air provided by the blowing module pass between the connecting tubes of the condensation module. One of the first direction and the second direction is parallel to a horizontal plane, and the other is a direction inclined at a first inclination angle with respect to the horizontal plane.

A plurality of fins may be disposed between the connecting tubes, a flow path may be provided in the third direction by the fins, and the first inclination angle may be between 1° and 10°.

The first direction may be parallel to the horizontal plane, and the second direction may be a direction inclined at the first inclination angle with respect to the horizontal plane. In the condensation module, a fluid inlet may be connected to a first header of a first header row, and a fluid outlet may be connected to a second header of an Nth header row. In the respective header rows, the first header may be located in a position higher than a location of the second header.

The evaporative condenser may further include a discharge case connected to a lower portion of the condensation module and a device frame on which the condensation module, the water injection module, and the blowing module are mounted. The first header may be located in a position higher than the second header, the discharge case may have a height on one side higher than a height on the other side thereof in a state of being mounted on the device frame, and the first header may be disposed on an upper side of the one side of the discharge case.

The discharge case may include a discharge port on a side surface and a drain port on a lower surface, and the discharge port may be provided on the one side.

The water injection module may include a water supply pipe connected to a water supply source and a water supply nozzle connected to the water supply pipe, and the water supply pipe may extend in a horizontal direction. The condensation module may be mounted to the device frame through a housing, and an upper surface of the housing may be configured parallel to the horizontal plane.

BRIEF DESCRIPTION OF DRAWINGS

The above and other aspects, features, and advantages of the present disclosure will be more clearly understood from the following detailed description, taken in conjunction with the accompanying drawings, in which:

FIG. 1 is a schematic diagram of an air conditioning system including an evaporative condenser;

FIG. 2 is a perspective view of a condensation module and a discharge case of an evaporative condenser;

FIG. 3 is a perspective view of a condensation module;

FIG. 4 is an exploded perspective view of a condensation module;

FIG. 5 is a schematic diagram of an evaporative condenser including a condensation module;

FIG. 6 is a cross-sectional view of a header of a condensation module; and

FIG. 7 is a cross-sectional view of an evaporative condenser according to an embodiment.

DETAILED DESCRIPTION

Hereinafter, detailed embodiments will be described with reference to the accompanying drawings. However, the spirit of the present disclosure is not limited to the presented examples, and those skilled in the art who understand the spirit of the present disclosure can easily suggest other degenerative inventions or other embodiments included in the scope of the present disclosure through the addition, change, or deletion of other components within the scope of the same spirit, and this will also be included within the scope of the spirit of the present disclosure.

In addition, throughout the specification, it means that a component being 'connected' to another component includes not only the case where these components are 'directly connected', but also the case where they are 'indirectly connected' through other components. In addition, 'including' a certain component means that other components may be further included, rather than excluding other components unless otherwise specified.

In addition, components having the same function within the scope of the same idea appearing in the drawings of each embodiment are described using the same reference numerals.

An air conditioning system includes a refrigerant cycle (R1) including a condensation module 200 in which the compressed refrigerant is condensed, an expansion valve 120 for expanding the refrigerant having passed through the condensation module 200, an evaporator 130 in which the refrigerant having passed through the expansion valve 120 is evaporated, and a compressor 140 for compressing the refrigerant having passed through the evaporator 130.

The air conditioning system may be an air conditioner, and as the condensation module 200, an evaporative condensation module 200 using water may be used. The outdoor unit including the evaporative condensation module 200 may be referred to as an evaporative condenser 100, and the evaporative condenser 100 is a device including the evaporative condensation module 200, and includes an outdoor unit of an air conditioner, but is not limited to an outdoor unit of an air conditioner. For example, the evaporative condenser 100 may be other devices if the evaporative condensation module 200 is included.

The evaporative condenser 100 includes the condensation module 200 including a connecting tube; a water injection module 300 for injecting water passing through the condensation module from above the condensation module 200; and a blowing module 310 (see FIG. 5) disposed on one side of the condensation module 200 to provide air passing through the condensation module 200.

The evaporative condenser 100 may be an outdoor unit disposed at a location spatially separated from indoors. An air passage A1 connected externally is provided to supply air to the condensation module 200. On the other hand, an indoor unit 150 is provided with a circulation passage A10 circulating the inside thereof, and in the circulation passage A10, indoor air is cooled while passing through the evaporator 130.

The air in the air passage A1 passes through the condensation module 200 and then is discharged externally after the temperature thereof rises. A water supply passage W1 connected to the water supply source is sprayed to the condensation module 200 by the water injection module 300 and is then drained externally through a discharge case 290 (see FIG. 2) disposed below the condensation module 200. As the refrigerant cycle R1 passes through the condensation module 200, the refrigerant is condensed by air in the air passage A3 and water in the water supply passage W1.

FIG. 2 is a perspective view of the discharge case 290 connected to the condensation module 200.

As illustrated in FIG. 2, the water supplied from the water injection module 300 and the air supplied from the air passage A1 pass through the discharge case 290 connected to the lower part of the condensation module 200, and the discharge case 290 is configured such that water falls to the bottom, and air escapes externally through a discharge port 292 provided on the side.

On the other hand, FIGS. 3 to 6 illustrate the condensation module 200 according to an embodiment. In detail, FIG. 3 illustrates a schematic perspective view of the condensation module 200 of an embodiment, FIG. 4 is an exploded perspective view of the condensation module 200 of FIG. 3, FIG. 5 illustrates a schematic diagram of the evaporative condenser 100 including the condensation module 200 of FIG. 3, FIG. 6 is a cross-sectional perspective view of first headers 211, 221, and 231 of first to third header rows 210, 220, and 230 of the condensation module 200 of FIG. 3.

As illustrated in FIGS. 3 to 6, the condensation module 200 of an embodiment includes first to sixth header rows 210, 220, 230, 240, 250, and 260. A fluid inlet (I) is connected to the first header row 210 and a fluid outlet (O) is connected to the sixth header row 260. Covers 281 and 282 are disposed on both sides of connecting tubes 213, 223, 233, 243, 253, and 263 of the first to sixth header rows 210, 220, 230, 240, 250, and 260, and between respective connecting tubes 213, 223, 233, 243, 253 and 263, a fin member (F) to help heat exchange is disposed.

In addition, the water injection module 300 for spraying water is disposed above the condensation module 200, and the blowing module 310 for flowing air between the connecting tubes 213, 223, 233, 243, 253, and 263 is disposed below the condensation module 200.

In the condensation module 200, the fluid (refrigerant) flows into the first header row 210, which is the lower part thereof, and exits through the sixth header row 260, which is the upper part thereof. Water is sprayed from top to bottom through the water injection module 300. The air is moved from the top to the bottom by the blower module 310 disposed at the lower portion and passes through fins F between the connecting tubes 213, 223, 233, 243, 253, and 263. Water evaporates while passing between the connecting tubes 213, 223, 233, 243, 253 and 263, and the fluid passing through the condensation module 200 is condensed by heat exchange between the fluid and the water/air due to the latent heat of evaporation and the sensible heat of the water/air. At this time, the heat exchange area can be increased by the fin member F disposed between the connecting tubes 213, 223, 233, 243, 253, and 263.

In this embodiment, it is described that the air is pulled from the top to the bottom by the blowing module 310, but the present disclosure is not limited thereto. For example, it is also possible to operate in a manner in which the blower module 310 is disposed at the upper portion and pushes air to the condensation module 200. Furthermore, the air flow itself may also flow from the bottom to the top, opposite to the pouring direction.

In the case of the condensation module 200 according to an embodiment, since fluid passes in a first direction (1), which is the extension direction of the header, a second direction (2), which is the extension direction of the connecting tube, and a third direction (3), which is the stacking direction of the header rows, the condensation module 200 has a three-dimensional structure, and thus, even if it occupies the same volume, relatively more heat exchange is possible, thereby improving cooling performance. In this case, since the first direction, the second direction, and the third direction are different directions from each other, and manufacturing and assembling may be facilitated due to having an orthogonal direction.

The fluid enters from the fluid inlet, flows along the first headers 211, 221, 231, 241, 251, and 261, passes through the connecting tubes 213, 223, 233, 243, 253, and 263, and then enters the second headers 212, 222, 232, 242, 252 and 262, moves in the third direction from the second headers 212, 222, 232, 242, 252, and 262, and then, passes through the connecting tubes 213, 223, 233, 243, 253 and 263 from the second headers 212, 222, 232, 242, 252, and 262, and goes to the first headers 211, 221, 231, 241, 251, 261. These processes are repeated. For example, the fluid flows from the first header to the second header and then flows from the second header to the first header while changing direction in the second direction. When changing direction, the cross-sectional area through which the fluid passes may be reduced. In the second direction, a direction from the first headers 211, 221, 231, 241, 251 and 261 to the second headers 212, 222, 232, 242, 252 and 262 is referred to as a 2-1 direction, and a direction from the second headers 212, 222, 232, 242, 252, and 262 toward the first headers 211, 221, 231, 241, 251, and 261 is referred to as a 2-2 direction.

The first header 211 of the first header row 210 has a tubular shape in which one side thereof in the longitudinal direction is connected to the fluid inlet I, and the other side is blocked by a baffle 211*b*. In the case of the first header 211 of the first header row 210, a passage hole 211*c* is formed in an upper portion, and a passage hole 221*c* is also formed in a lower portion of the first header 221 of the second header row 210 in a position corresponding to the passage hole 211*c* of the first header row 210, such that the first header 211 of the first header row 210 and the first header 221 of the second header row 220 communicate with each other. Furthermore, in the case of the first header 221 of the second header row 220, the passage hole 221*c* is provided not only at the lower part but also at the upper part facing the first header 231 of the third header row 230, and the passage hole 231*c* is also formed in the first header 231 of the third header row 230 in a position corresponding to the passage hole 221*c*. The fluid introduced into the first header 211 of the first header row 210 is moved to the first header 221 of the second header row 220 and the first header 231 of the third header row 230.

Since the structure of the condensation module 200 is disclosed in Korean Patent Application Publication No. 10-2022-0074734, a detailed description thereof will be omitted.

For the manufacture of the condensation module 200, the first direction (1), the second direction (2), and the third direction (3) are formed in a manner orthogonal to each other, and the fin member (F) is formed to allow a connecting tube in the third direction (3) through which air and water pass. Therefore, while passing through the condensation module 200, water forms on the fin (F)/connecting tube 213. When water is condensed, the heat exchange efficiency is reduced, and the static pressure of the condensation module is increased, thereby reducing the energy efficiency of the evaporative condenser.

FIG. 7 illustrates a schematic diagram of an evaporative condenser 100 according to an embodiment.

As illustrated in FIG. 7, the evaporative condenser 100 includes a water injection module 300, a condensation module 200 and a discharge case 290 disposed in a device frame 101, and also includes a blowing module for forming an air flow to the condensation module 200 although not illustrated.

As illustrated in this embodiment, the water injection module 300 includes a water supply pipe 301 extending in the horizontal direction, above the condensation module 200, and a nozzle 301 connected to the water supply pipe 301 and disposed toward the bottom, and the water supply pipe 301 is connected to a water supply source.

The condensation module 200 has basically the same configuration as the configuration of the condensation module 200 of FIGS. 3 to 6, but includes a housing 201 in order for the condensation module 200 to be mounted on the device frame 101.

The upper surface of the housing 201 is parallel to the horizontal plane, but the lower surface connected to the discharge case 290 is inclined with respect to the horizontal plane.

In the embodiment of FIG. 7, the condensation module 200 is disposed such that the first direction 1 in which the headers 211 and 212 extend in the condensation module 200 is parallel to the horizontal plane, while the second direction 2 in which the connecting tube 213 extends is inclined at a first inclination angle θ with respect to the horizontal plane. In detail, in the header row comprised of the first header 211, the second header 212 and the connecting tube 213, the first header 211 is disposed to extend parallel to the second header at a position higher than the second header 212. As the second direction 2 is inclined at the first inclination angle θ with respect to the horizontal plane, the water collected in the connecting tube 213 and the fin F flows in one direction due to the inclination, and therefore, the water is easily drained.

In the condensation module 200 of this embodiment, fluid is supplied to the first header 211 of the first header row, and the fluid is discharged through the second header of the sixth header row.

Meanwhile, the upper surface of the discharge case 290 disposed below the condensation module 200 is inclined at the first inclination angle θ, and the lower surface thereof is configured such that a drain 295 is located in a lowest position. A discharge port 292 is disposed on one side of the discharge case 290.

The water and air having passed through the condensation module 200 pass through the discharge case 290, and the water falls down and exits through the drain 295, and air passes through the discharge port 292 and is discharged externally. One side 293 of the upper surface where the discharge portion 292 is disposed is disposed below the first header 211 of the condensation module 200, and the other side 294 opposite to the one side 293 is disposed below the second header 212.

In the evaporative condenser 100 of FIG. 7, the results of the experiment while changing the first inclination angle θ are illustrated in Table 1. In Table 1, the amounts of heat of condensation according to inclination angles were measured while only the first inclination angle was changed while other conditions except for the first inclination angle were the same.

TABLE 1

| first inclination angle (θ) of 0° | amount of condensation heat (latent heat, W) |
|---|---|
| 0 | 11454 |
| 6 | 11463 |
| 12.7 | 11375 |
| 19.6 | 11175 |
| 45.4 | 11026 |
| 61.3 | 10955 |

In Table 1, the first inclination angle (0) of 0° indicates that it is parallel to the horizontal plane, a relatively small angle indicates that the condensation module 200 is slightly tilted, and a relatively great angle indicates that a tilt is increased.

In the case of increasing the first inclination angle (θ), the amount of condensation heat (latent heat, W) initially increased, but when the first inclination angle θ was changed to 12.7° or more, it was confirmed that the amount of condensation heat rather decreased.

Therefore, the first inclination angle θ may be greater than 0 and less than 12.7°, in detail, between 1 and 10°. Considering the increase in product size due to the inclination angle, it may be set to 10° or less.

On the other hand, Table 2 describes the high pressure and static pressure according to the first inclination angle. As illustrated in Table 2, when the first inclination angle (θ) was 0°, the high pressure was 21.48 kgf and the static pressure was −30.38 mmaq, and when the first inclination angle (θ) was 3°, it was confirmed that the high pressure was 20.20 kgf and the static pressure was −29.53 mmaq.

TABLE 2

| first inclination angle (θ) of 0° | high pressure (kgf) | static pressure (mmaq) |
|---|---|---|
| 0 | 21.48 | −30.38 |
| 3 | 21.2 | −29.53 |

For example, it was confirmed that the high pressure in the condensation module 200 is lowered and the static pressure is reduced due to the presence of the first inclination angle (θ), and this means that less energy can be consumed to pass air through the condensation module 200 and means that the overall energy efficiency of the evaporative condenser 100 is improved.

In this embodiment, it is described that the first direction 1 in which the headers 211 and 212 extend is parallel to the horizontal plane, and the second direction 2 in which the connecting tube 213 extends is inclined to the horizontal plane, but the present disclosure is not limited thereto. For example, a method in which the second direction 2 in which the connecting tube extends is parallel to the horizontal plane and the first direction 1 is inclined to the horizontal plane may be applied.

On the other hand, in the condensation module 200, the first inclination angle θ may be inclined toward the fluid inlet (I, see FIG. 3) or toward the fluid outlet (O, see FIG. 3). In the experiment, it was confirmed that the difference in performance according to the tilting direction was not large, but the condensation heat slightly increased when tilted toward the fluid outlet (O).

As set forth above, by the above configuration, an evaporative condenser in which condensation efficiency may be improved may be provided, and energy efficiency of an evaporative condenser may be improved by lowering static pressure of the evaporative condenser.

While example embodiments have been illustrated and described above, it will be apparent to those skilled in the art that modifications and variations could be made without departing from the scope of the present disclosure as defined by the appended claims.

What is claimed is:

1. An evaporative condenser comprising:

a condensation module comprising N header rows including a first header extending in a first direction and having a flow path therein, a second header extending in the first direction and having a flow path therein, and a plurality of connecting tubes extending in a second direction between the first header and the second header and connecting the flow paths of the first header and the second header are stacked in a third direction, where N is a natural number greater than or equal to 2;

a water injection module comprising a water supply pipe and nozzles configured to spray water passing through the condensation module, above the condensation module;

a blowing module disposed on one side of the condensation module and comprising a fan configured to supply air passing through the condensation module; and a discharge case connected to a lower portion of the condensation module and a device frame on which the condensation module, the water injection module, and the blowing module are mounted, wherein the discharge case has a first height on one side higher than a second height on the other side thereof in a state of being mounted on the device frame, wherein the condensation module is mounted to the device frame through a housing; wherein an upper surface of the housing is parallel to a horizontal plane; and wherein a lower surface of the housing, that is connected to the discharge case, is inclined with respect to the horizontal plane, wherein the first to third directions are directions orthogonal to each other, the condensation module, the water injection module, and the blowing module are disposed in such a manner that the water sprayed by the water injection module and the air provided by the blowing module pass between the plurality of connecting tubes of the condensation module, one of the first direction and the second direction is parallel to a horizontal plane, and the other is a direction inclined at a first inclination angle with respect to the horizontal plane, and a fluid outlet for liquefied fluid is connected to an Nth header row which is located at the highest position in the third direction.

2. The evaporative condenser of claim 1, wherein between the plurality of connecting tubes, a plurality of fins are disposed, wherein a flow path is provided in the third direction by the fins.

3. The evaporative condenser of claim 2, wherein the first inclination angle is between 1° and 10°.

4. The evaporative condenser of claim 3, wherein the first direction is parallel to the horizontal plane, and the second direction is a direction inclined at the first inclination angle with respect to the horizontal plane.

5. The evaporative condenser of claim 4, wherein in the condensation module, a fluid inlet is connected to a first header of the first header row, and a fluid outlet is connected to a second header of the Nth header row, wherein in the respective header rows, the first header is located in a position higher than a location of the second header.

6. The evaporative condenser of claim 4, wherein the first header is located in a position higher than the second header, the first header is disposed on an upper side of the one side of the discharge case.

7. The evaporative condenser of claim 6, wherein the discharge case includes a discharge port on a side surface and a drain port on a lower surface, wherein the discharge port is provided on the one side.

8. The evaporative condenser of claim 7, wherein the water injection module includes a water supply pipe connected to a water supply source and a water supply nozzle connected to the water supply pipe, and the water supply pipe extends in a horizontal direction.

9. An evaporative condenser comprising:

a condensation module comprising N header rows including a first header extending in a first direction and having a flow path therein, a second header extending in the first direction and having a flow path therein, and a plurality of connecting tubes extending in a second direction between the first header and the second header and connecting the flow paths of the first header and the second header are stacked in a third direction, where N is a natural number equal to or greater than 2;

a water injection module above the condensation module, and including a water supply pipe and a spray nozzle connected to the water supply pipe to spray water passing through the condensation module;

a blowing module disposed on one side of the condensation module and comprising a fan configured to supply air passing through the condensation module; and a discharge case connected to a lower portion of the condensation module and a device frame on which the condensation module, the water injection module, and the blowing module are mounted, wherein the discharge case has a first height on one side higher than a second height on the other side thereof in a state of being mounted on the device frame, wherein the condensation module is mounted to the device frame through a housing; wherein an upper surface of the housing is parallel to a horizontal plane; and wherein a lower surface of the housing, that is connected to the discharge case, is inclined with respect to the horizontal plane, wherein a plurality of fins are disposed between the plurality of connecting tubes, and a flow path is formed in the third direction by the fins, the first to third directions are directions orthogonal to each other, the condensation module, the water injection module, and the blowing module are disposed such that the water injected by the water injection module and the air provided by the blowing module pass between the plurality of connecting tubes of the condensation module and the fins, when viewed in the first direction, an extension direction of the water supply pipe and the second direction are obliquely intersected at a first inclination angle, and a fluid outlet for liquefied fluid is connected to an Nth header row which is located at the highest position in the third direction.

* * * * *